United States Patent [19]

Sugiyama et al.

[11] Patent Number: 4,875,337

[45] Date of Patent: Oct. 24, 1989

[54] CONSTRUCTION MACHINE DUAL-DUMP HYDRAULIC CIRCUIT WITH PILOTED ARM-BOOM CYLINDER SUPPLY PRIORITY SWITCHING VALVES

[75] Inventors: Genroku Sugiyama, Ibaraki; Toichi Hirata, Ushiku; Shinichi Satoh, Ibaraki, all of Japan

[73] Assignee: Hitachi Construction Machinery Co., Ltd., Tokyo, Japan

[21] Appl. No.: 101,427

[22] Filed: Sep. 28, 1987

[30] Foreign Application Priority Data

Sep. 27, 1986 [JP] Japan ..... 61-227116

[51] Int. Cl.[4] ..... F15B 13/09; F15B 13/06; E02F 3/32

[52] U.S. Cl. ..... 60/421; 60/427; 91/522; 91/529; 91/531; 414/699; 414/730

[58] Field of Search ..... 91/516, 521, 522, 525, 91/526, 529, 530–532, 535, 536, 517; 60/421, 422, 427; 414/699, 700, 703, 740

[56] References Cited

U.S. PATENT DOCUMENTS

| | | | |
|---|---|---|---|
| 3,800,669 | 4/1974 | Distler | 60/421 X |
| 3,838,573 | 10/1974 | Laumond | 91/532 X |
| 4,030,623 | 6/1977 | Bridwell et al. | 60/421 X |
| 4,078,681 | 3/1978 | Field | 60/421 X |
| 4,210,061 | 7/1980 | Bianchetta | 91/531 X |
| 4,528,892 | 7/1985 | Okabe et al. | 91/531 X |
| 4,561,341 | 12/1985 | Aikawa | 91/531 X |
| 4,561,824 | 12/1985 | Okabe et al. | 91/531 X |

FOREIGN PATENT DOCUMENTS 57-173601 10/1982 Japan ..... 91/530

*Primary Examiner*—Robert E. Garrett
*Assistant Examiner*—George Kapsalas
*Attorney, Agent, or Firm*—Antonelli, Terry & Wands

[57] ABSTRACT

A hydraulic circuit for a construction machine which operates an actuator for working machine simultaneously with an actuator for working element without degrading the operation of the actuator for working machine. The hydraulic circuit comprises a first hydraulic pump, a first directional control valve connected to the first hydraulic pump and controlling an operation of the working machine actuator, a third directional control valve controlling an operation of the working element actuator, a second directional control valve connected to a second hydraulic pump, a first pilot operating device for controlling an operation of the first directional control valve and a second pilot operating device for controlling an operation of the third directional control valve. The hydraulic circuit further comprises a first hydraulic fluid joining device for providing hydraulic fluid of the second hydraulic pump to the input side of third directional control valve, a second hydraulic fluid joining device for supplying the hydraulic fluid of the second hydraulic pump to the input side of the first directional control valve, and a priority switching device for preventing, in response to a signal of the first pilot operating device, the signal of the second pilot operating device from being applied to the second directional control valve.

7 Claims, 5 Drawing Sheets

CONSTRUCTION MACHINE DUAL-DUMP HYDRAULIC CIRCUIT WITH PILOTED ARM-BOOM CYLINDER SUPPLY PRIORITY SWITCHING VALVES

BACKGROUND OF THE INVENTION

1. Field of the Invention

The present invention relates to a hydraulic circuit for hydraulic construction machines such as a hydraulic excavator, and more particularly to a hydraulic circuit for construction machines for driving an actuator for a working machine or an actuator for a working element by joining hydraulic fluid flows of a plurality of hydraulic pumps.

2. Description of the Prior Art

A hydraulic construction machine and a hydraulic circuit used therein according to the prior art will now be described with reference to FIGS. 1 and 2.

FIG. 1 is a side elevational view showing an example of an excavator in which a nibbler is used as a working element instead of a bucket.

The hydraulic excavator shown in FIG. 1 includes a track 102 travelled by a hydraulic motor 101, a swing 104 mounted on the track 102 and rotated by a swing motor 103, a boom 106 rotatably mounted on the swing 104 and driven by a hydraulic cylinder for boom 105, an arm 108 rotatably mounted on the boom 106 and driven by a hydraulic cylinder for arm 107, and a nibbler 301 rotatably mounted on the arm 108 and rotated by a hydraulic cylinder for bucket 109. Reference numeral 111 denotes an operation lever provided within a cab and for driving the hydraulic cylinder for arm 107, for example. The bucket, the nibbler and the like, and the arm and the boom will hereinafter be respectively referred to as a working element and a working machine.

Generally, the hydraulic circuit shown in FIG. 2 is used in the hydraulic excavator that uses the nibbler 301 as the working element. A pilot operating valve 201 is connected to the operation lever 111. The pilot operating valve 201 is adapted to adjust a pressure of the hydraulic fluid from a pilot pump 202 in accordance with an operating amount of the operation lever 111, thus changing a first directional control valve 1. Reference numeral 50 denotes a first hydraulic pump that is adapted to supply the hydraulic fluid to a first directional control valve group 51 including a directional control valve 54 for the swing motor 103 and the first directional control valve 1 for the hydraulic cylinder for arm 107 disposed downstream of the directional control valve 1. The directional control valve 1 is provided with a first output port 3 connected through a passageway 31 to a bottom side chamber 30 of the hydraulic cylinder 107, a first input port 8 to which the hydraulic fluid is supplied through a check valve 6 from a center-bypass passageway, a second output port 4 connected through a passageway 33 to a rod side chamber 32 of the hydraulic cylinder 107, and a second input port 9 to which the hydraulic fluid is supplied through a check valve 7 from a parallel-passageway 55. A restrictor 10 is interposed in a passageway connecting the first and second input ports 8 and 9 together. The restrictor 10 is for operating the swing motor 103 and the hydraulic cylinder for arm 107 at the same time in favorable manner. When an arm crowding operation (arm lowering operation) of which hydraulic pressure is low and a swing operation of the swing motor 103 of which hydraulic pressure is high are performed at the same time, the restrictor 10 prevents a lot of the hydraulic fluid from flowing into the bottom side chamber 30 of the hydraulic cylinder for arm 107 of which hydraulic pressure is low, so that the hydraulic fluid is supplied to the swing motor 103 of which hydraulic pressure is high. Thus, it is prevented that only the arm crowding operation is performed and the swing operation is not performed.

When an arm damping operation (arm raising operation) of which hydraulic pressure is high and the swing operation are performed at the same time, the hydraulic fluid is supplied to the rod side chamber 32 of the hydraulic cylinder for arm 107 from the parallel-passageway without passing through the restrictor 10 and further when only the arm crowding operation is performed, the hydraulic fluid is supplied to the bottom side chamber 30 from the center-bypass passageway without passing through the restrictor 10. Accordingly, the operation of the hydraulic cylinder for arm 107 is satisfactory.

Reference numeral 52 denotes a second hydraulic pump for supplying hydraulic fluid to a second directional control valve group 53 including a second directional control valve 2 for joining the hydraulic fluid. The directional control valve 2 is provided with an input port 11, a first output port 22 connected to a rod side chamber 81 of the hydraulic cylinder for nibbler 302, and a second output port 5 connected to a bottom side chamber 82 thereof. The directional control valve 2 is changed over simultaneously with the changing over of the directional control valve 306 by means of a pilot valve 303 driven by an operation lever 304, thereby joining the hydraulic fluid of the second hydraulic pump 52 with the hydraulic fluid of the first hydraulic pump 50 and thereby providing the joined hydraulic fluid to the hydraulic cylinder 302. In such a hydraulic circuit, the joined hydraulic fluid of the first and second hydraulic pumps 50 and 52 is supplied to the hydraulic cylinder for nibbler 302 but only the hydraulic fluid derived from the first hydraulic pump 50 is supplied to the working machine actuator (the hydraulic cylinder for arm 107 is shown by way of example in FIG. 2). This would deteriorate the workability of the arm 108. This is because in the ordinary hydraulic excavator that uses a bucket as a working element, the hydraulic cylinder for arm receives the hydraulic fluid from the first and second hydraulic pumps 50 and 52.

Also, when it is desired to carry out simultaneously the arm damp operation (i.e., raising operation) and the operation of the nibbler 301, in the case where there is no object to be gripped by the nibbler 301 or it is then necessary to release the gripping action of the nibbler 301, the hydraulic pressure for the nibbler 301 is low relative to that of the arm 108. As a result, the hydraulic fluid derived from the hydraulic pump 50 would flow to the hydraulic cylinder for nibbler 302 but would not be supplied to the hydraulic cylinder for arm 107. For this reason, there is a disadvantage in that it is impossible to carry out the damp operation of the arm 108 simultaneously with the operation of the nibbler 301.

SUMMARY OF THE INVENTION

Accordingly, in order to overcome the above noted defects, an object of the present invention is to provide a hydraulic circuit for a construction machine, which may operate the working machine and the working element simultaneously without deteriorating the operability of the working machine.

According to the present invention there is provided a hydraulic circuit for a construction machine, which comprises an actuator for working machine, an actuator for working element, first and second hydraulic pumps, first and third directional control valves connected to the first hydraulic pump, the first directional control valve controlling an operation of said working machine actuator and the third directional control valve controlling an operation of the working element actuator, a second directional control valve connected to the second hydraulic pump, first pilot operating means for controlling an operation of the first directional control valve and second pilot operating means for controlling an operation of the third directional control valve, the hydraulic circuit being characterized by comprising first hydraulic fluid joining means for joining hydraulic fluid of the second hydraulic pump with hydraulic fluid of said first hydraulic pump, the first hydraulic fluid joining means being adapted to connect a first output port of the second directional control valve to an input side of said third directional control valve, second joining means for joining the hydraulic fluid of the second hydraulic pump with the hydraulic fluid of the first hydraulic pump, the second joining means being adapted to connect an input side of the second directional control valve to an input side of the first directional control valve and priority switching means for, in response to a signal of the first pilot operating means, preventing a signal of the second pilot operating means from being applied to the second directional control valve.

Preferably, the second directional control valve includes an input port and has a changed position for causing the input port and the first output port to communicate with each other in response to a signal from the first pilot operating means for carrying out a crowd operation of the working machine actuator.

Preferably, the first hydraulic fluid joining means includes a passageway for connecting the first output port of the second directional control valve and an input port of the third directional control valve.

Preferably, the first hydraulic fluid joining means includes a passageway for connecting the first output port of the second directional control valve and a passageway between the first hydraulic pump and the third directional control valve, and a restrictor valve provided in a parallel-passageway of the first hydraulic pump, the restrictor valve having a restriction position for restricting the parallel-passageway in response to a signal from the first pilot operating means, for carrying out a crowd operation of the working machine actuator.

Preferably, the first directional control valve has a first input port and a second input port, and the second hydraulic fluid joining means has a passageway for connecting the first input port and an upstream side of the second directional control valve, a passageway for connecting the second input port and an upstream side of the second directional control valve, and a passageway for connecting the first and second input ports to each other having a restrictor.

Preferably, the second hydraulic fluid joining means has a passageway for connecting an upstream side of the input port of the second directional control valve and an input port of the first directional control valve, and a restrictor valve interposed in the mentioned passageway for selectively taking a neutral position for restricting the mentioned passageway and a changed position for communicating the flow passage in response to a signal from the first pilot operating means for carrying out a damp operation of the working machine actuator.

Preferably, the priority switching means includes a switching valve for taking a neutral position for allowing a signal from the second pilot operating means to communicate with the second directional control valve, and a changed position for preventing the signal of the second pilot operating means from being in communication with the second directional control valve when the first pilot operating means has produced a signal.

Preferably, the priority switching means includes a shuttle valve to which a pilot passageway is connected from the second pilot operating means, the shuttle valve selectively taking a changed position for, in response to a signal from the first pilot operating means, preventing a signal from the second pilot operating means from being in communication with the second directional control valve.

DETAILED DESCRIPTION OF THE PREFERRED EMBODIMENTS

Figure 1:
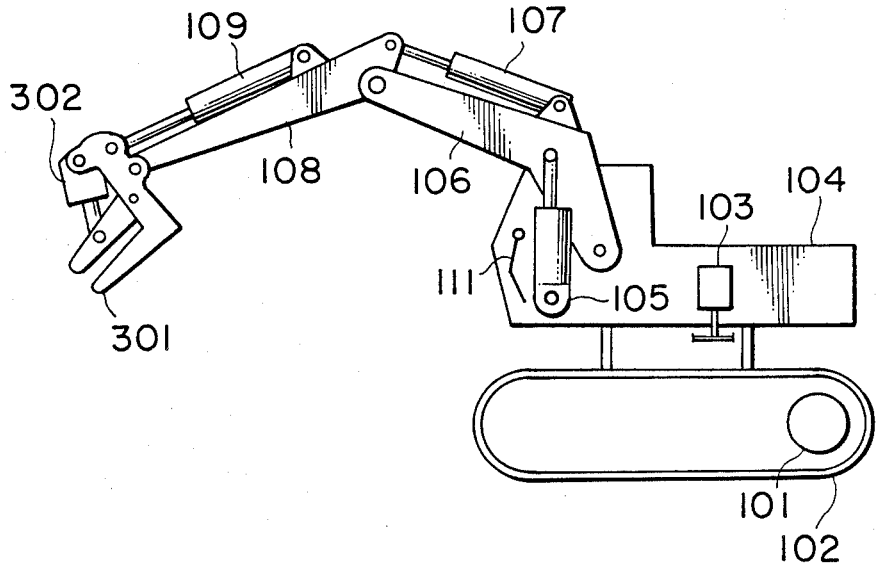
FIG. 1 is a view showing an outer appearance of a hydraulic excavator in which a nibbler is used as a working element instead of a bucket.
Figure 2:
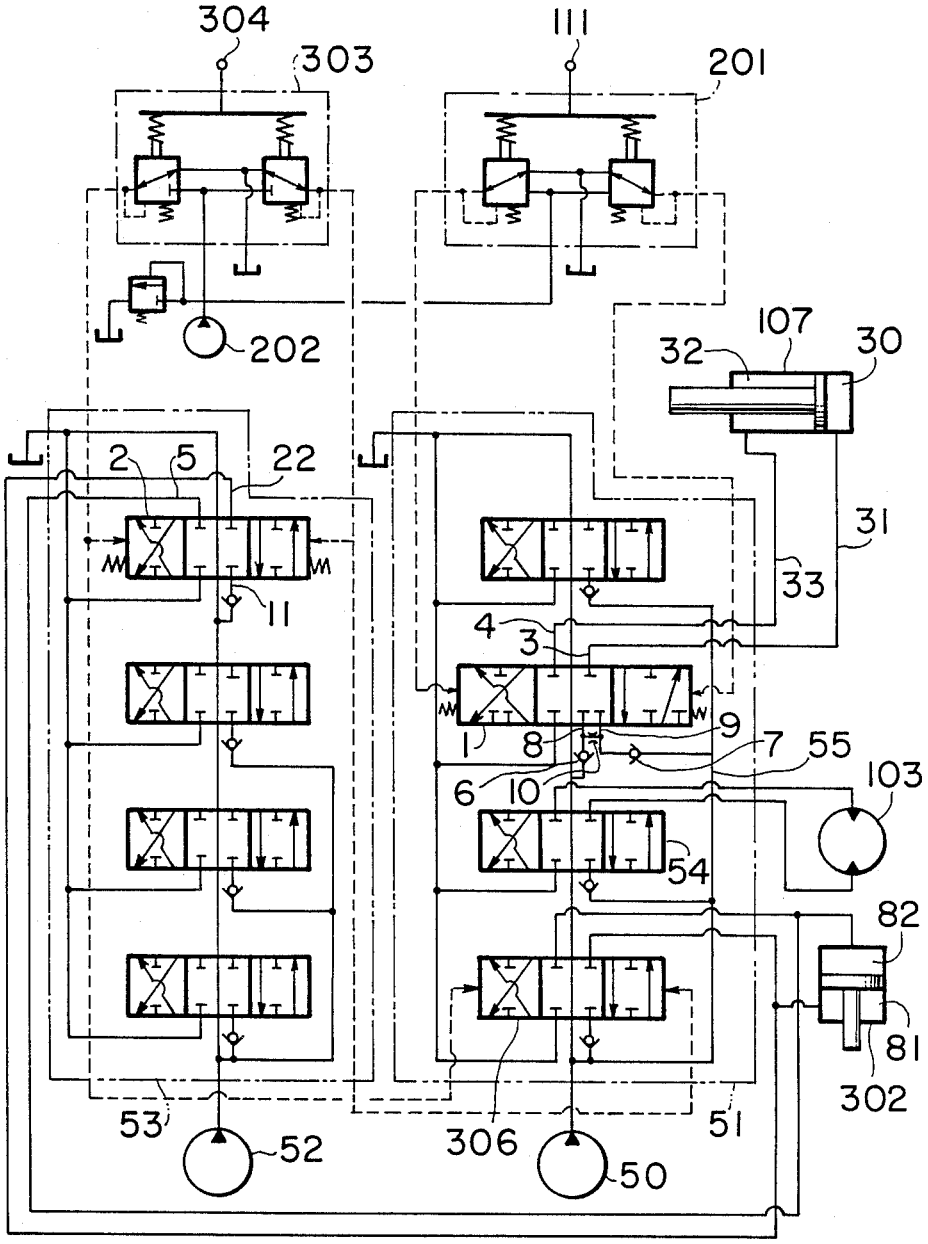
FIG. 2 PRIOR ART
FIG. 2 is a diagram showing a hydraulic circuit according to the prior art used in the hydraulic excavator shown in FIG. 1, in which hydraulic cylinder for arm is used as a working machine actuator.

Each hydraulic circuit of a construction machine according to the present invention will now be described with reference to FIGS. 3 to 5.

A first embodiment of the present invention shown in FIG. 3 will now be described.

There are provided a first hydraulic pump 50 and a second hydraulic pump 52. Connected to the first hydraulic pump 50 is a first directional control valve group 51 including a plurality of directional control valves through which a center-bypass passageway 56 connected to the first hydraulic pump 50 passes. Connected to the second hydraulic pump 52 is a second directional control valve group 53 including a plurality of directional control valves through which a center-bypass passage 58 connected to the second hydraulic pump 52 passes. The first directional control valve group 51 includes a first directional control valve 1 for controlling an operation of a hydraulic cylinder for arm 107 of the hydraulic excavator, and a third directional control valve 306 for controlling an operation of a working element actuator, i.e., a hydraulic cylinder for nibbler 302.

The first directional control valve 1 has a first output port 4 connected through a passageway 33 to a rod side chamber 32 of the hydraulic cylinder for arm 107, a second output port 3 connected through a passageway 31 to a bottom side chamber 30 of the hydraulic cylinder for arm 107, a first input port 9 to which hydraulic fluid is supplied from a parallel-passageway 55 connected to the first hydraulic pump 50, a second input port 8 to which hydraulic fluid is supplied from a center-bypass passageway 56, and a drain port 70. Check valves 6 and 7 are provided for the second input port 8 and the first input port 9, respectively. The second input port 8 downstream of (the check valve 6 and the input port 9 downstream of) the check valve 7 are connected to each other through a passageway 12. A restrictor 10 is interposed in the passageway 12.

The second directional control valve group 53 includes a second directional control valve 2 for joining the hydraulic fluid of the second hydraulic pump 52 with the hydraulic fluid of the first hydraulic pump 50. The second directional control valve 2 has and input port 11 connected to the center-bypass passageway 58 connected to the second hydraulic pump 52, a drain port 71, a first output port 22, and a second output port 5. The second output port 5 is connected to the bottom side chamber 30 of the hydraulic cylinder for arm 107 through the passageway 31.

The third directional control valve 306 has a input port 21 connected to the first hydraulic pump 50, a drain port 72, and first and second output ports 74 and 73 connected to a rod side chamber 81 and a bottom side chamber 82 of the hydraulic cylinder for nibbler 302, respectively.

The input port 11 of the second directional control valve 2 is connected to a passageway 57 through a passageway 40 and is further connected to the first input port 9 of the first directional control valve 1 through another passageway 41. Check valves 13 and 14 are interposed in the passageways 40 and 41, respectively, the check valves allowing the hydraulic fluid to flow in only one direction from the second directional control valve 2 to the first directional control valve 1. The second output port 22 is connected to the input port 21 of the third directional control valve 306 through a passage 323.

A first operation lever 111 for controlling an operation of the hydraulic cylinder for arm 107 is provided in a cab (not shown) and connected to a first pilot operating valve 201. The first pilot operating valve 201 produces a signal pressure in accordance with an amount of a movement of the first operation lever 111, and is connected to pilot chambers of the respective directional control valves 1 and 2 so as to change over the first and second directional control valves 1 and 2. An operation lever 304 for controlling an operation of the hydraulic cylinder for nibbler 302 is also provided in the cab (not shown) and is connected to a second pilot operating valve 303. The second pilot operating valve 303 produces a signal pressure in accordance with an amount of a movement of the second operation lever 304 and is connected to pilot chambers of the third directional control valve 306 so as to change over the third directional control valve 306.

The second directional control valve 2 has one changed position where a communication between the input port 11 and the first output port 22 is only allowed and the other changed position where a communication between the second output port 5 and the drain port 71 is only allowed.

The signal pressure derived from the second pilot operating valve 303 is also in communication with one of the pilot chambers of the second directional control valve 2 through a shuttle valve 330, a pilot leading passageway 321 and shuttle valve 322. That pilot chamber is a pilot chamber for changing over the second directional control valve 2 to the first changed position (left side changed position) when it receives the signal.

A priority control valve 320 is provided for opening/closing the pilot leading passageway 321. The vale 320 is interposed midway in the pilot leading passageway 321. A pilot chamber of the priority control valve 320 is connected to the first pilot operating valve 201 through the shuttle valve 327 and a pilot passageway 328. When the priority control valve 320 receive the signal pressure from the first pilot operating valve 201, it is changed to a closed position where the pilot leading passageway 321 located downstream of the priority control valve 320 is in communication with a tank.

The operation will now be described.

Figure 3:
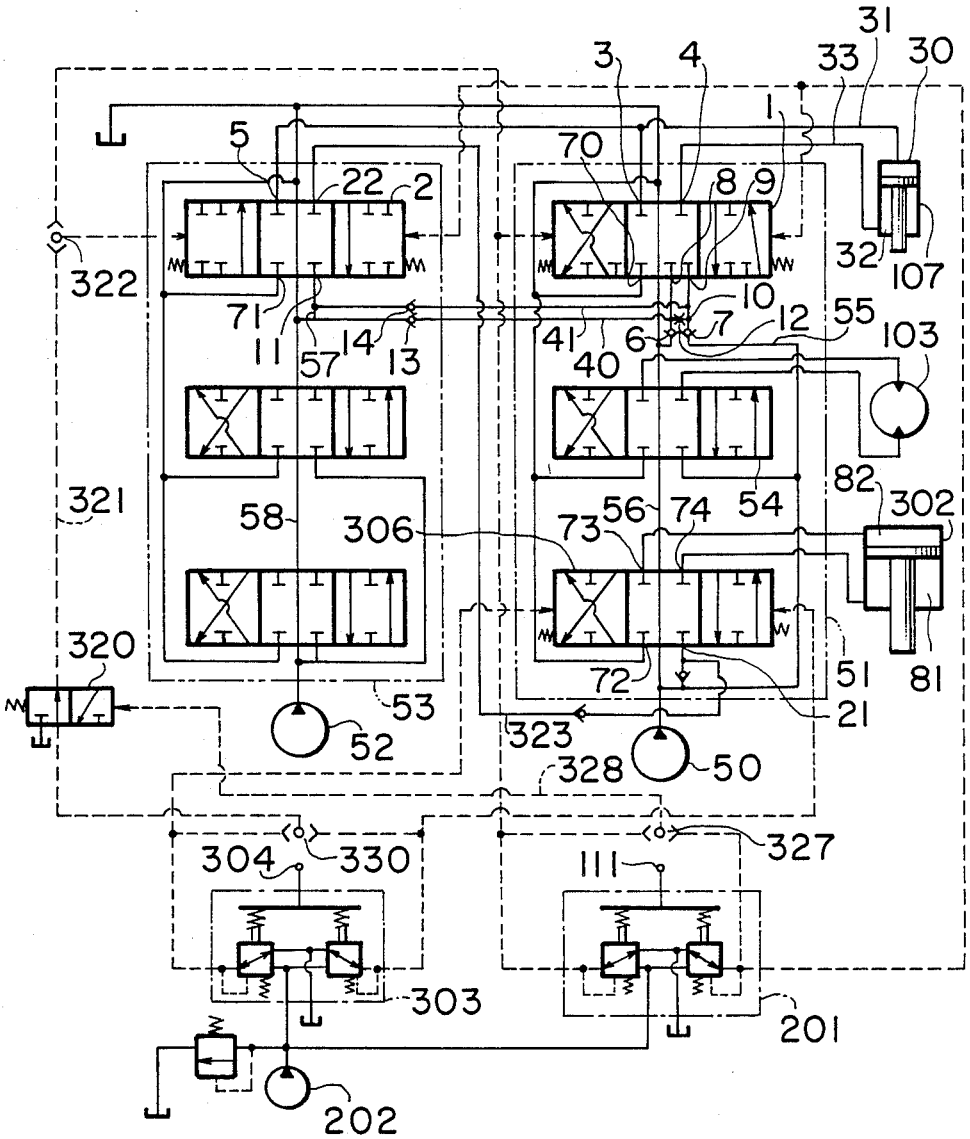
FIG. 3 is a diagram showing a hydraulic circuit according to a first embodiment of the invention, in which hydraulic cylinder for arm is used as a working actuator as shown in FIG. 2.

When the am crowd operation is performed, that is, when the hydraulic cylinder for arm 107 is extended to lower the arm, the first and second directional control valves 1 and 2 are changed over to the left changed positions in FIG. 3 in response to the signal pressure of the pilot operating valve 201, respectively. The hydraulic fluid of the first hydraulic pump 50 is supplied from the center-bypass passageway 56 through the second input port 8 of the first directional control valve 1 and the second output port 3 thereof and the passageway 31 to the bottom side chamber 30 of the hydraulic cylinder for arm 107. The hydraulic fluid of the second hydraulic pump 52 is supplied from the center-bypass passageway 58 through the passageway 40 to the second input port 8 of the first directional control valve 1. Thus, the hydraulic fluid of the first hydraulic pump 50 and the hydraulic fluid of the second hydraulic pump 52 are joined together, thereby entering into the bottom side chamber 30 of the hydraulic cylinder for arm 107 to thereby perform the arm crowd operation. The return hydraulic fluid from the rod side chamber 32 of the hydraulic cylinder for arm 107 is returned to the tank through the passageway 33, the first output port 4 and the drain port 70.

When the arm damp operation is performed, that is, when the hydraulic cylinder for arm 107 is retracted to raise the arm, the first and second directional control valves 1 and 2 are changed over to the right changed positions in FIG. 3 in accordance with the signal pressure of the first pilot operating valve 201, respectively. The hydraulic fluid of the first hydraulic pump 50 is supplied from the parallel-passageway 55 through the first input port 9 of the first directional control valve 1, the output port 4 thereof and the passageway 33 to the rod side chamber 32 of the hydraulic cylinder for arm 107. The hydraulic fluid of the second hydraulic pump 52 is supplied from the center-bypass passageway 58 through the passageway 41 to the first input port 9 of the first directional control valve 1. Thus, the hydraulic fluid of the first hydraulic pump 50 and the hydraulic fluid of the second hydraulic pump 52 are joined together, thereby entering into the rod side chamber 32 of the hydraulic cylinder for arm 107 to thereby perform the arm damp operation. The return fluid from the bottom side chamber 30 of the hydraulic cylinder for arm 107 is returned to the tank through the passageway 31, the second output port 3 and the drain port 70 and is also returned through the passageway 31, the second output port 5 and the drain port 71 to the tank.

When the arm damp operation and the nibbler operation are performed at the same time, the priority control valve 320 is changed over to the closed position in accordance with the signal pressure derived from the first pilot operating valve 201, so that the pilot leading passageway 321 downstream of the priority control valve 320 is in communication with the tank. As a result, the signal pressure from the second pilot operating valve 303 is not fed to the second directional control valve 2. Therefore, the first and second directional control valves 1 and 2 are changed over to the right changed positions in FIG. 3 in accordance with the signal pressure from the first pilot operating valve 201. The third directional control valve 306 is changed over suitably to the left and right changed positions in accordance with the operational direction of the second pilot operating lever 304. The hydraulic fluid of the first hydraulic pump 50 is supplied through the input port 21, the output port 73 or the output port 74 of the third directional control valve 306 to the bottom side chamber 82 of the hydraulic cylinder for nibbler 302 or the rod side chamber 81 thereof, and at the same time, is supplied to the rod side chamber 32 of the hydraulic cylinder for arm 107 through the first input port 9 of the first directional control valve 1, the first output port 4 thereof and the passageway 33 from the parallel-passageway 55. The hydraulic fluid of the second hydraulic pump 52 is supplied from the center-bypass passageway 58 through the passageway 41 to the input port 9 of the first directional control valve 1. Thus, the hydraulic fluid of the first hydraulic pump 50 and the hydraulic fluid of the second hydraulic pump 52 are joined together, and are supplied to the rod side chamber 32 of the hydraulic cylinder for arm 107 to thereby perform the arm damp operation. At the same time, the nibbler operation is performed by the hydraulic fluid of the first hydraulic pump 50 since during the arm damp operation, a pressure enough to drive the hydraulic cylinder for nibbler 302 is generated in the parallel-passageway 55 by the hydraulic pressure to move the arm.

When the arm crowd operation and the nibbler operation are performed at the same time, in the same way as described above, the priority control valve 320 is changed over to the closed position in accordance with the signal pressure derived from the first pilot operating valve 201 and is kept in the closed condition. Therefore, the signal pressure of the second pilot operation valve 303 is not transmitted to the second directional control valve 2. Thus, the first and second directional control valves 1 and 2 are changed over to the left changed positions in FIG. 3 in accordance with the signal pressure derived from the first pilot operating valve 201. The hydraulic fluid of the first hydraulic pump 50 is supplied from the parallel-passage 55 through the restrictor 10 to the second input port 8 of the first directional control valve 1. Because the hydraulic fluid passes through the restrictor 10, the restrictor causes the pressure to be enough to drive the hydraulic cylinder for nibbler 302 in the parallel-passageway 55 upstream of the restrictor 10. Accordingly, the hydraulic fluid of the first hydraulic pump 50 is supplied through the third directional control valve 306 to the hydraulic cylinder for nibbler 302. The hydraulic fluid of the second hydraulic pump 52 is supplied from the center-bypass passageway 58 through the passageway 40 to the second input port 8 of the first directional control valve 1 and is joined with the hydraulic fluid of the first hydraulic pump 50 that has passed through the restrictor 10. The joined hydraulic fluid is supplied through the second output port 3 of the first directional control valve 1 and the passageway 31 to the bottom side chamber 30 of the hydraulic cylinder for arm 107. The second hydraulic pump 52 communicates through the input port 11 and the first output port 22 of the second directional control valve 2 and the passageway 323 to the input port 21 of the third directional control valve 306 but the pressure of the hydraulic cylinder for arm 107 is lower than that of the hydraulic cylinder for nibbler 302. Accordingly, the hydraulic fluid is not supplied to the hydraulic cylinder for nibbler 302. In this case, the hydraulic cylinder for arm 107 is operated by the joined hydraulic fluid of the first and second hydraulic pumps 50 and 52.

In this embodiment, even if the hydraulic cylinder for nibbler 302 is operated, since the hydraulic cylinder for arm 107 is operated by the joined hydraulic fluid of the first and second hydraulic pumps 50 and 52, its operability is not degraded.

A second embodiment of the present invention will now be described with reference to FIG. 4, in which the like components or members are designated by the same reference numerals in FIG. 3. Explanation will be made only with respect to the difference between the first and second embodiments.

A first directional control valve 100 has a second output port 3 connected to the bottom chamber 30 of the hydraulic cylinder for arm 107 through passageway 31, a first output port 4 connected to the rod side chamber 32 of the hydraulic cylinder for arm 107 through the passageway 33, an input port 15 through which the hydraulic fluid is supplied from the parallel-passageway 55 connected to the first hydraulic pump 50, and a drain port 70. A check valve 7 is provided for the input port 15.

A restrictor valve 43 is interposed in a passageway 41 that connects the center-bypass passageway 58 of the second hydraulic pump 52 and the input port 15 of the first directional control valve 100 to each other. The restrictor valve 43 has a restriction position (neutral position) for restricting the passageway 41 and a changed position for allowing the communication of the passageway 41. Its pilot chamber is connected through a passageway 251 to a pilot passageway 250 for transmitting a signal for operating the arm damp operation of the first pilot operating valve 201.

The signal pressure of the second pilot operating valve 303 is also communicated to one of the pilot chambers of the second directional control chamber 2 through a shuttle valve 326, and the pilot leading passageway 321. Unlike the first embodiment, the pilot leading passageway 321 is connected directly to the pilot chamber provided in the second directional control valve 2 without the provision of the shuttle valve 322. The shuttle valve 326 is a shuttle valve having a changed position for preventing the signal from the second pilot operating valve 303 from being transmitted to the second directional control valve 2 and for allowing the pilot leading passageway 321 to communicate with the tank. Its pilot chamber is connected to the pilot passageway 250 for transmitting the signal for operating the arm damp operation of the first pilot operating valve 201 in the same manner as in the restrictor valve 43.

When the arm damp operation and the nibbler operation are performed at the same time, the shuttle valve 326 is changed over to the changed position in accordance with the signal pressure derived from the first pilot operating valve 201 so that the signal pressure of the second pilot operating valve 303 is not communicated with the directional control valve 2. Therefore, the first and second directional control valves 100 and 2 are changed over to the right changed positions in FIG. 4 in accordance with the signal pressure from the first pilot operating valve 201. The hydraulic fluid of the first hydraulic pump 50 is supplied through the third directional control valve 306 to the hydraulic cylinder for nibbler 302, and at the same time is supplied from the parallel-passageway 55 to the input port 15 of the first directional control valve 100. Since the restrictor valve 43 is changed over to the changed position in accordance with the signal pressure of the first operating valve 201, that is, the signal pressure for performing the arm damp operation, the hydraulic fluid of the second hydraulic pump 52 is supplied from the center-bypass passageway 58 to the input port 15 of the first directional control valve 100 through the passageway 41 without any restriction of the restrictor valve 43 and is joined with the hydraulic fluid of the first hydraulic pump 50. The joined hydraulic fluid is supplied through the first output port 4 and the passageway 33 to the rod side chamber 32 of the hydraulic cylinder for arm 107.

Figure 4:
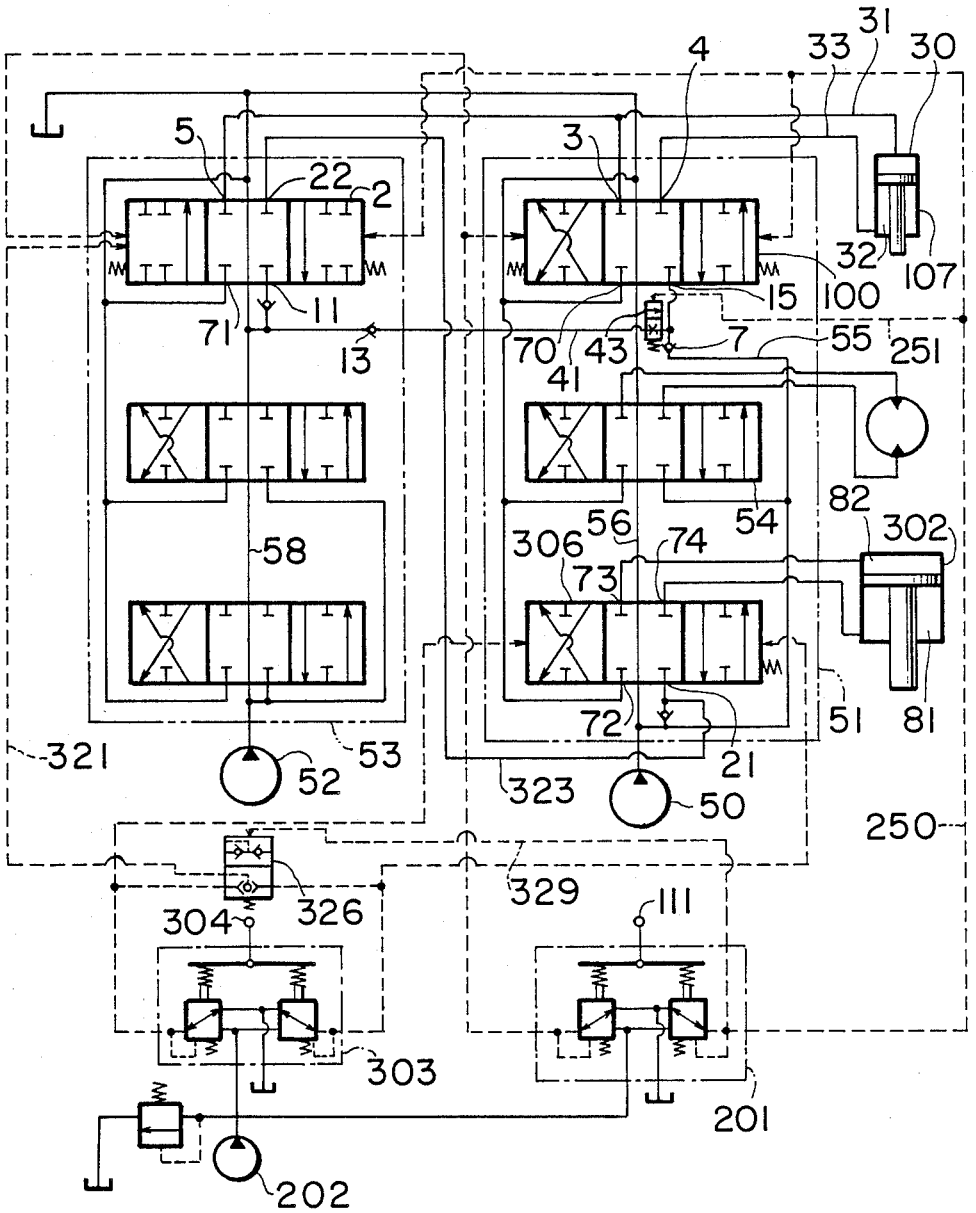
FIG. 4 is a diagram showing a hydraulic circuit in accordance with a second embodiment of the invention.
Figure 5:
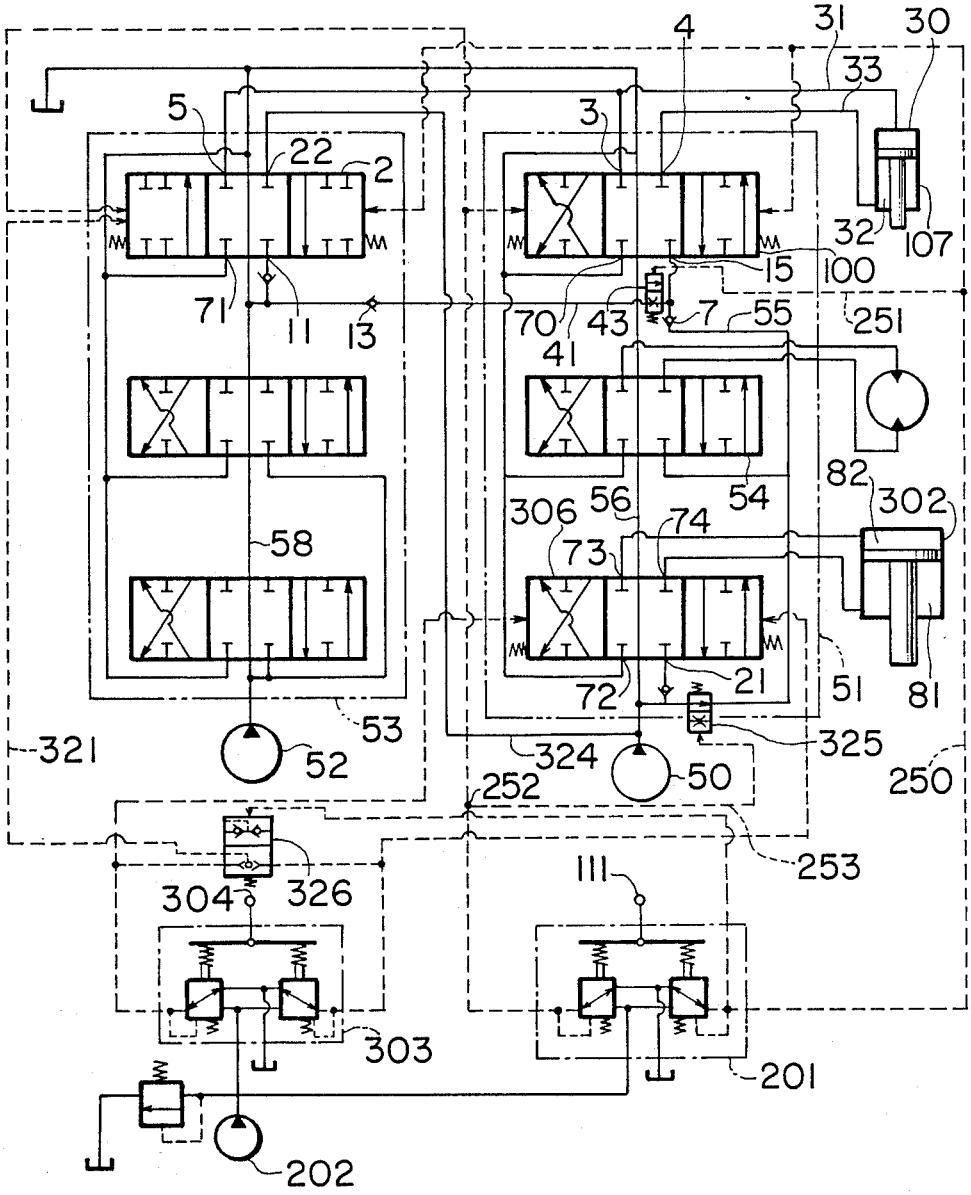
FIG. 5 is a diagram showing a hydraulic circuit in accordance with a third embodiment of the invention.

When the arm crowd operation and the nibbler operation are performed at the same time, the first directional control valve 100 is changed over to the left changed position in FIG. 4 in accordance with signal pressure derived from the first pilot operating valve 201. The second directional control valve 2 is changed over to the left changed position in FIG. 4 in accordance with the signal pressure from the first pilot operating valve 201 and the signal pressure passing from the second pilot operating valve 303 through the neutral position of the shuttle valve 326 and the pilot leading passageway 321. The hydraulic fluid of the first hydraulic pump 50 is supplied from the parallel-passageway 55 to the input port 15 of the first directional control valve 100. The hydraulic fluid of the second hydraulic pump 52 is supplied from the center-bypass passageway 58 through the input port 11 of the second directional control valve 2 and the first output port 22 thereof and the passageway 323 to the input port 21 of the third directional control valve 306 and then is introduced into the hydraulic cylinder for nibbler 302. At this time, the second hydraulic pump 52 is in communication with also the input port 15 of the first directional control valve 100 through the passageway 40 with the restrictor valve 43 in the restricting position, but the restrictor valve 43 causes the pressure enough to drive the hydraulic cylinder for nibbler 302 in the center-bypass passageway 58. The hydraulic fluid of the first hydraulic pump 50 and the hydraulic fluid of the second hydraulic pump 52 that has passed through the restrictor valve 43 are joined at the input port 15 and supplied to the bottom side chamber 30 of the hydraulic cylinder for arm 107.

Also according to this embodiment, when the hydraulic cylinder for nibbler is operated, the hydraulic cylinder for arm 107 is actuated by the joined hydraulic fluids of the first and second hydraulic pumps 50 and 52.

A third embodiment of the invention will now be described with reference to FIG. 5, in which the like components or members are designated by the same reference numerals as in the foregoing embodiments shown in FIGS. 3 and 4. Explanation will be made only with respect to the differences therebetween.

The third embodiment is different from the foregoing embodiments in the following points in arrangement. Namely, in the third embodiment, the first output port 22 of the second directional control valve 2 is connected through the passageway 324 to the center-bypass passageway 56 provided between the first hydraulic pump 50 and the third directional control valve 306. Also, a restrictor valve 325 is interposed in the parallel-passageway 55. The restrictor valve 325 has a communication position for allowing the communication of the parallel-passageway 55 and a changed over position for restricting the parallel-passageway 55. Its pilot chamber is connected through the pilot passageway 253 to the pilot passageway 252 for transmitting the signal for arm crowd operation from the first pilot operating valve 201.

When the arm damp operation and the nibbler operation are performed at the same time, since the restrictor valve 325 is in the communication position, the operation is the same as in the second embodiment.

When the arm crowd operation and the nibbler operation are performed at the same time, the restrictor valve 325 is changed over to the changed position for restricting the parallel-passageway 55 in accordance with the signal pressure for the arm crowd operation from the first pilot operating valve 201. The hydraulic fluid of the second hydraulic pump 52 is joined with the hydraulic fluid of the first hydraulic pump 50 from the center-bypass passageway 58 through the input port 11 of the second directional control valve 2, the first output port 22 thereof and the passageway 324. In the arm crowd operation, the pressure of the hydraulic cylinder for arm 107 becomes low. Therefore, the joined hydraulic fluid of the first and second hydraulic pumps 50 and 52 is caused to pass through the restrictor valve 325, so that a pressure enough to drive the hydraulic cylinder for nibbler 302 is produced upstream of the restrictor valve 325. The joined hydraulic fluid is supplied through the restrictor valve 325 from the parallel-passageway 55 to the input port 15 of the first directional control valve 100 and is further supplied through the passageway 31 to the bottom side chamber 30 of the hydraulic cylinder for arm 107. Furthermore, the joined hydraulic fluid is supplied to the hydraulic cylinder for nibbler 302. The hydraulic fluid of the second hydraulic pump 52 is supplied from the center-bypass passageway 58 through the passageway 41 to the first directional control valve 100. At this time, since the restrictor valve 43 is in the restricting position, a pressure enough to drive the hydraulic cylinder for nibbler 302 is produced upstream of the restrictor valve 43 in the same manner as in the restrictor valve 325. Also, the hydraulic fluid that has been supplied to the first directional control valve 100 trough the restrictor valve 43 is joined with the hydraulic fluid from the parallel-passageway 55 and is supplied to the hydraulic cylinder for arm 107.

In this embodiment, when the hydraulic cylinder for nibbler 302 is operated, the hydraulic cylinder for arm 107 is operated by the hydraulic fluid of the first and second hydraulic pumps 50 and 52. Thus, the operability would not be deteriorated.

As has been described above, even in the same time operation of the arm operation and the nibbler operation, since the hydraulic cylinder for arm 107 is operated by the joined hydraulic fluid of the first and second hydraulic pumps, thus preventing the deterioration in operability. According to the present invention, it is possible to provide a hydraulic circuit for a construction machine that may operate the working machines together with the working element without deteriorating the operability of the working machines

What is claimed is:

1. A hydraulic circuit for a construction machine comprising:

an acutator for working machine;

an actuator for working element;

first and second hydraulic pumps;

first and third directional control valves connected to said first hydraulic pump, said first directional control valve controlling an operation of said actuator for working machine and said third directional control valve controlling an operation of said actuator for working element;

a second directional control valve connected to said second hydraulic pump, said second directional control valve including a neutral position at which a communication between said second hydraulic pump and a first output port of said second directional control valve is blocked and a communication between said actuator for working machine and a reservoir is blocked, one changed position at which said communication between said second hydraulic pump and said first output port is allowed and said communication between said actuator for working machine and the reservoir is blocked and another changed position at which said communication between said second hydraulic pump and said first output port is blocked and said communication between said actuator for working machine and the reservoir is allowed;

first pilot operating means for controlling operation of said first and second directional control valves;

second pilot operating means for controlling an operation of said third directional control valve and for shifting said second directional control valve to said one changed position;

first hydraulic fluid joining means for joining hydraulic fluid of said second hydraulic pump with hydraulic fluid of said first hydraulic pump, said first hydraulic joining means connecting said first output port of said second directional control valve to an input side of said third directional control valve;

second hydraulic fluid joining means for joining the hydraulic fluid of said second hydraulic pump with the hydraulic fluid of said first hydraulic pump, said second joining means connecting an input side of said second directional control valve to an input side of said first directional control valve; and priority control means for, when a signal of said first pilot operating means is issued, preventing a signal of said second pilot operating means from being applied to said second directional control valve, said priority control means including a first passageway for leading the signal of said second pilot operating means to said second directional control valve, a device interposed in said first passageway for closing said first passageway when the signal of said first pilot operating means is received and a second passageway interconnecting between said device and said first pilot operating means to lead to said device the signal of said first pilot operating means to close said first passageway;

whereby said actuator for wording element is actuated by the hydraulic fluid from the first and second hydraulic pumps joined by said first hydraulic fluid joining means when only said second pilot operating means is operated and said actuator for working machine is actuated by the hydraulic fluid from the first and second hydraulic pumps joined by said second hydraulic fluid joining means when only said first pilot operating means is operated and also when said first and second pilot operating means are operated at the same time.

2. The hydraulic circuit according to claim 1, wherein said first hydraulic fluid joining means includes a passageway for connecting said first output port of said second directional control valve and an input port of said third directional control valve.

3. The hydraulic circuit according to claim 1, wherein said first hydraulic fluid joining means includes a passageway for connecting said first output port of said second directional control valve and a passageway between said first hydraulic pump and said third directional control valve, and restrictor valve provided in a parallel-passageway of said first hydraulic pump, said restrictor valve having a restriction position for restricting said parallel-passageway in response to a signal from said first pilot operating means for carrying out a crowd operation of said working machine actuator.

4. The hydraulic circuit according to claim 1, wherein said first directional control valve has a first input port and a second input port, and said second hydraulic fluid joining means has a passageway for connecting said first input port and an upstream side of said second directional control valve, a passageway for connecting said second input port and an upstream side of said second directional control valve, and a passageway for connecting said first and second input ports to each other having a restrictor.

5. The hydraulic circuit according to claim 1, wherein said second hydraulic fluid joining means has a passageway for connecting an upstream side of said input port of said second directional control valve and an input port of said first directional control valve, and a restrictor valve interposed in the mentioned passageway for selectively taking a neutral position for restricting the mentioned passageway and a changed position for opening said passageway in response to a signal from said first pilot operating means for carrying out a damp operation of said working machine actuator.

6. The hydraulic circuit according to claim 1, wherein said device of the priority control means includes a priority control valve for taking a neutral position for allowing a signal from said second pilot operating means to communicate with said second directional control valve, and a changed position for preventing said signal of said second pilot operating means from being in communication with said second directional control valve when said first pilot operating means has produced a signal.

7. The hydraulic circuit according to claim 1, wherein said priority switching means includes a shuttle valve to which a pilot passageway is connected from said second pilot operating means, said shuttle valve selectively taking a changed position for, in response to a signal from said first pilot operating means, preventing a signal from said second pilot operating means from being in communication with said second directional control valve.

* * * * *